US009812797B2

(12) United States Patent
Yamamoto et al.

(10) Patent No.: US 9,812,797 B2
(45) Date of Patent: Nov. 7, 2017

(54) CONNECTION STRUCTURE AND CONNECTION METHOD FOR TERMINAL FITTING

(71) Applicant: YAZAKI CORPORATION, Tokyo (JP)

(72) Inventors: Takatatsu Yamamoto, Shizuoka (JP); Keiichi Mita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/363,605

(22) Filed: Nov. 29, 2016

(65) Prior Publication Data

US 2017/0155202 A1 Jun. 1, 2017

(30) Foreign Application Priority Data

Nov. 30, 2015 (JP) ..... 2015-233574

(51) Int. Cl.

| | |
|---|---|
| ***H01R 11/11*** | (2006.01) |
| ***H01R 11/09*** | (2006.01) |
| ***H01R 11/28*** | (2006.01) |
| ***H01R 4/18*** | (2006.01) |
| ***H01R 4/04*** | (2006.01) |

(52) U.S. Cl.

CPC ..... *H01R 11/09* (2013.01); *H01R 4/04* (2013.01); *H01R 4/188* (2013.01); *H01R 11/28* (2013.01)

(58) Field of Classification Search

CPC .... H01R 13/28; H01R 13/111; H01R 13/187; H01R 4/185; H01R 4/183; H01R 11/12

USPC ..... 439/287, 842, 843, 851, 877, 878, 883

See application file for complete search history.

(56) References Cited

U.S. PATENT DOCUMENTS

| | | | | |
|---|---|---|---|---|
| 4,012,101 | A * | 3/1977 | Damoisiaux | H01R 4/2495 439/422 |
| 7,115,004 | B2 * | 10/2006 | Takayama | H01R 4/185 439/850 |
| 7,125,295 | B2 * | 10/2006 | Zhao | H01R 11/12 439/287 |
| 7,252,559 | B1 * | 8/2007 | Morello | H01R 4/185 439/843 |
| 7,252,564 | B1 * | 8/2007 | Morello | H01R 4/185 439/843 |

(Continued)

FOREIGN PATENT DOCUMENTS

JP 2012-190749 A 10/2012

*Primary Examiner* — Thanh Tam Le

(74) *Attorney, Agent, or Firm* — Kenealy Vaidya LLP

(57) ABSTRACT

A connection structure of a terminal fitting includes the terminal fitting including a terminal body, and a plurality of terminal connection portions extending from the terminal body and connection terminals connected to end portions of electric wires. Each of the connection terminals includes a pair of fastening caulking pieces which erects on opposite side portions of a terminal bottom portion. The pair of the fastening caulking pieces are caulked with opposite side portions of a corresponding one of the terminal connection portions from outside so that the connection terminal is caulked and fastened to the terminal fitting. Concave-convex engagement portions are provided in opposed surfaces in which the terminal connection portion and the terminal bottom portion abut against each other. The terminal fitting is connected to the electric wires through the connection terminals.

4 Claims, 11 Drawing Sheets

(56) References Cited

U.S. PATENT DOCUMENTS

| | | | | |
|---|---|---|---|---|
| 7,316,581 | B2 * | 1/2008 | Kumakura | H01R 4/182<br>439/422 |
| 7,494,388 | B2 * | 2/2009 | Kakuta | H01R 4/185<br>439/877 |
| 7,556,541 | B2 * | 7/2009 | Tyler | H01R 13/03<br>439/843 |
| 9,172,151 | B2 * | 10/2015 | Sato | H01R 4/206 |
| 9,350,109 | B2 * | 5/2016 | Ohnuma | H01R 4/184 |
| 9,379,479 | B2 * | 6/2016 | Ohnuma | H01R 4/185 |

* cited by examiner

CONNECTION STRUCTURE AND CONNECTION METHOD FOR TERMINAL FITTING

CROSS REFERENCE TO RELATED APPLICATIONS

This application claims priority from Japanese Patent Application No. 2015-233574 filed on Nov. 30, 2015, the entire contents of which are incorporated herein by reference.

BACKGROUND OF THE INVENTION

Field of the Invention

The present invention relates to a connection structure and a connection method for a terminal fitting.

Description of Related Art

There has been known a connection structure in which connection plates of a plurality of terminal fittings, to which grounding electric wires have been connected, are put on top of one another, a common bolt is inserted into mounting holes provided in the connection plates to thereby bolt and fasten the connection plates to a grounding surface (such as a predetermined place of a vehicle body), so that the grounding electric wires can be conductively connected to the grounding surface in a lump through the terminal fittings put on top of one another (for example, see Patent Literature 1: JP-A-2012-190749).

[Patent Literature 1] JP-A-2012-190749

According to a related art, in a structure in which terminal fittings put on top of one another are fastened by a bolt, the terminal fittings connected to grounding electric wires respectively are put on top of one another and fastened by the bolt. Therefore, the weight increases as the number of grounding electric wires increases. In addition, the thickness of the terminal fittings put on top of one another increases as the number of grounding electric wires increases. Thus, a large space for receiving the terminal fittings has to be secured above the grounding surface. In addition, much working time is required for fastening work while adjusting the nut length or the bolt length in accordance with the terminal fittings to be put on top of one another.

In addition, in order to conductively connect a plurality of grounding electric wires in a lump, it can be also considered to use a joint connector in which connection terminals connected to the grounding electric wires are inserted into a housing accommodating joint terminals to thereby conductively connect the grounding electric wires in a lump through the joint terminals while holding the connection terminals inside the housing. However, in the case of the joint connector, a holding mechanism (such as a lock lance) for holding the connection terminals inside the housing has to be provided. It is therefore difficult to miniaturize the housing. In addition, since the housing provided with the holding mechanism is required, the cost increases inevitably.

In addition, due to fastening by a bolt, reliability in connection may deteriorate after the connection because the bolt is loosened. In this case, when the connection terminals are crimped and fastened to the terminal fittings, a firm connection structure can be obtained. However, when the connection terminals and the terminal fittings are crimped by a crimping machine, there is a fear that their postures cannot be stabilized relatively to each other but a variation may occur in crimping strength.

SUMMARY

One or more embodiments provide a connection structure and a connection method for a terminal fitting capable of conductively connecting a plurality of electric wires in a lump with high reliability in connection while suppressing weight and saving space.

In an aspect (1), one or more embodiments provide a connection structure of a terminal fitting comprising:

the terminal fitting including a terminal body, and a plurality of terminal connection portions extending from the terminal body; and connection terminals connected to end portions of electric wires, wherein each of the connection terminals includes a pair of fastening caulking pieces which erects on opposite side portions of a terminal bottom portion, wherein the pair of the fastening caulking pieces are caulked with opposite side portions of a corresponding one of the terminal connection portions from outside so that the connection terminal is caulked and fastened to the terminal fitting, wherein concave-convex engagement portions are provided in opposed surfaces in which the terminal connection portion and the terminal bottom portion abut against each other, and wherein the terminal fitting is connected to the electric wires through the connection terminals.

In an aspect (2), the connection structure of the terminal fitting according to the aspect (1), wherein each of the concave-convex engagement portions includes concave grooves extending in a width direction of the terminal bottom portion and convex strips extending in the width direction of the terminal connection portion.

According to the aspect (1), fastening caulking pieces of connection terminals connected to end portions of electric wires are caulked to a plurality of terminal connection portions provided in the terminal fitting. Thus, the connection terminals are fastened to the terminal fitting so that the electric wires can be conductively connected to the terminal fitting in a lump. In this manner, it is not necessary to stack terminal fittings. In comparison with a structure in which terminal fittings connected to electric wires respectively are stacked and fastened for conductive connection, increase in weight of the terminal fitting can be suppressed even when the number of electric wires increases. In addition, since it is not necessary to stack terminal fittings, the thickness of the terminal fitting does not increase even if the number of electric wires to be conductively connected increases. Thus, space saving can be attained.

In addition, since the connection terminals are caulked and fastened to the terminal connection portions of the terminal fitting, it is possible to dispense with a special holding mechanism for holding the connection terminals. Thus, reduction in size and cost can be attained in comparison with a joint connector in which a holding mechanism for holding terminals has to be provided in a housing.

In addition, due to the structure in which separate connection terminals are caulked and fastened to the terminal fitting to be thereby connected thereto, the connection terminals to which electric wires having different diameters have been connected can be caulked and fastened to the terminal connection portions to be thereby conductively connected thereto. That is, electric wires having various sizes can be dealt with without changing the connection forms between the terminal connection portions of the terminal fitting and the fastening connection portions of the connection terminals. In addition, when terminal fittings differing in number of terminal connection portions are prepared, it is possible to easily deal with increase or decrease in number of electric wires to be conductively connected. As a result, any change in number or size of electric wires to be conductively connected can be dealt with by a required minimum variety of terminal fittings.

In addition, due to the structure in which connection terminals are fastened to a plurality of terminal connection portions of the terminal fitting, the connection terminals can be caulked and fastened to the terminal connection portions in accordance with necessity. Thus, the number of electric wires to be conductively connected in a lump can be increased or decreased within the range of the number of terminal connection portions.

Further, due to the concave-convex engagement portion provided in opposed surfaces where each terminal connection portion and a corresponding terminal bottom portion abut against each other, the terminal connection portion can be prevented from coming out from fastening caulking pieces. Thus, reliability in mechanical connection is improved in comparison with a structure in which connection terminals are connected only by caulking and fastening.

According to the aspect (2), the concave grooves extending in the width direction of the terminal bottom portion are engaged with the convex strips extending in the width direction of the caulked terminal connection portion so that the engagement margin of the concave-convex engagement portion can be increased. Thus, the terminal connection portion can be surely prevented from coming out from the fastening caulking pieces. In addition, the convex strips and the concave grooves can be formed easily in the terminal connection portion and the terminal bottom portion by press working. Thus, increase in the working cost can be suppressed.

In an aspect (3), one or more embodiments provide a connection method for a terminal fitting, in which the terminal fitting includes a terminal body and a plurality of terminal connection portions extending from the terminal body, and a pair of fastening caulking pieces which erects on opposite side portions of a terminal bottom portion in each of connection terminals connected to end portions of electric wires is caulked and connected to a corresponding one of the terminal connection portions, the connection method comprising:

mounting the terminal connection portion on the terminal bottom portion; and crushing and caulking the fastening caulking pieces with outer sides of opposite side portions of the terminal connection portion, and forming convex engagement portions in an opposed face abutting against the terminal connection portion in at least one of the terminal bottom portion and the fastening caulking pieces so that the connection terminal and the terminal connection portion are concave-convex engaged.

In an aspect (4), the connection method for the terminal fitting according to the aspect (3), wherein the fastening caulking pieces of the connection terminal are crushed and caulked so as to form the convex engagement portions including convex strips which extend in a width direction.

According to the aspect (3), the terminal connection portion of the terminal fitting is caulked by the fastening caulking pieces of the connection terminal, and at the same time the concave engagement portions are formed in the opposed face abutting against the terminal connection portion in the terminal bottom portion and/or the fastening caulking pieces. As a result, the concave engagement portions are formed in the terminal connection portion. According, the convex engagement portions and the concave engagement portions are engaged with each other so that the terminal connection portion can be prevented from coming out form the fastening caulking pieces. Thus, reliability in mechanical connection is improved in comparison with a structure in which connection is established only by caulking and fastening of the fastening caulking pieces.

According to the aspect (4), the convex engagement portions are formed as convex strips formed when the fastening caulking pieces of the connection terminal are crushed and caulked. Accordingly, the concave engagement portions formed in the terminal connection portion and engaged with the convex engagement portions are formed as concave grooves. Thus, the engagement margin between the convex engagement portions and the concave engagement portions can be increased so that the terminal connection portion can be surely prevented from coming out from the fastening caulking pieces. In addition, the convex strips and the concave grooves can be formed at the same time as the fastening caulking pieces of the connection terminal are crushed and caulked. Thus, increase in working cost can be suppressed.

According to one or more embodiments, it is possible to provide a connection structure and a connection method for a terminal fitting capable of conductively connecting a plurality of electric wires in a lump with high reliability in connection while suppressing weight and saving space.

The invention has been described briefly above. The further details of the invention will be made clearer through with reference to the accompanying drawings.

BRIEF DESCRIPTION OF THE DRAWINGS

FIG. 6A is a sectional view taken on line C-C in FIG. 5. FIG. 6B is a sectional view taken on line D-D in FIG. 5. FIG. 6C is a sectional view taken on line E-E in FIG. 5.

FIG. 8A is a sectional view taken on line A-A in FIG. 1B, showing a state where the fastening caulking pieces have not been fastened yet. FIG. 8B is a sectional view taken on line A-A in FIG. 1B, showing a state where the fastening caulking pieces are being fastened. FIG. 8C is a sectional view taken on line A-A in FIG. 1B, showing a state where the fastening caulking pieces have been fastened.

FIG. 11A is a sectional view taken on line F-F in FIG. 9B, showing a state where the fastening caulking pieces have not been fastened yet. FIG. 11B is a sectional view taken on line F-F in FIG. 9B, showing a state where the fastening caulking pieces are being fastened. FIG. 11C is a sectional view taken on line F-F in FIG. 9B, showing a state where the fastening caulking pieces have been fastened.

DETAILED DESCRIPTION

An embodiment of the invention will be described below with reference to the drawings (first embodiment).

First, a connection structure and a connection method for a terminal fitting according to the first embodiment of the invention will be described.

Figure 1A:
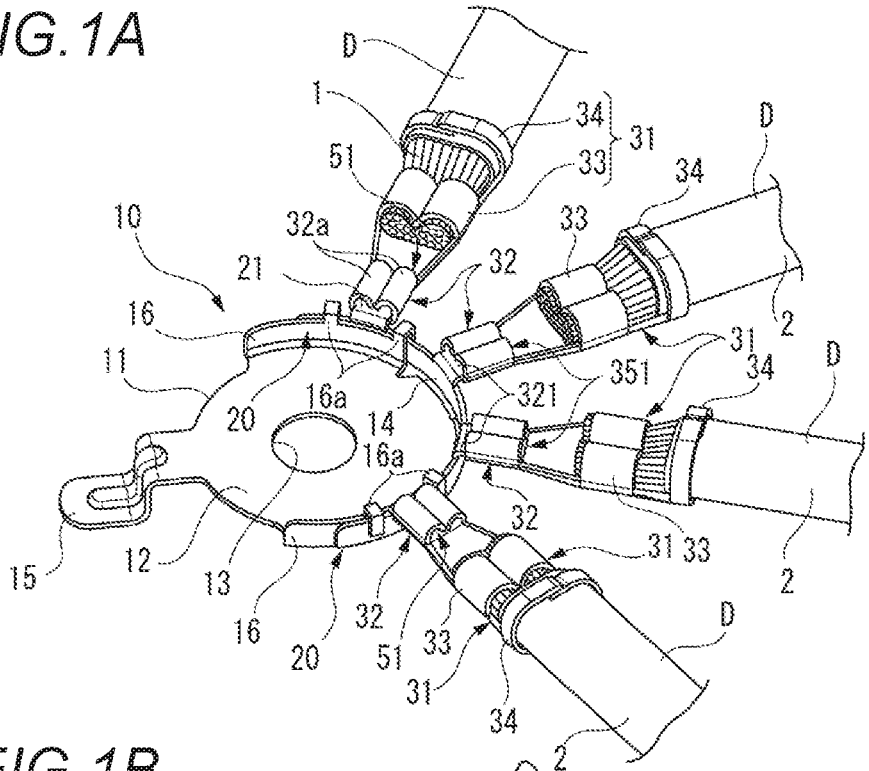
FIG. 1A is a perspective view of the terminal fitting to which grounding electric wires have been connected.
Figure 1B:
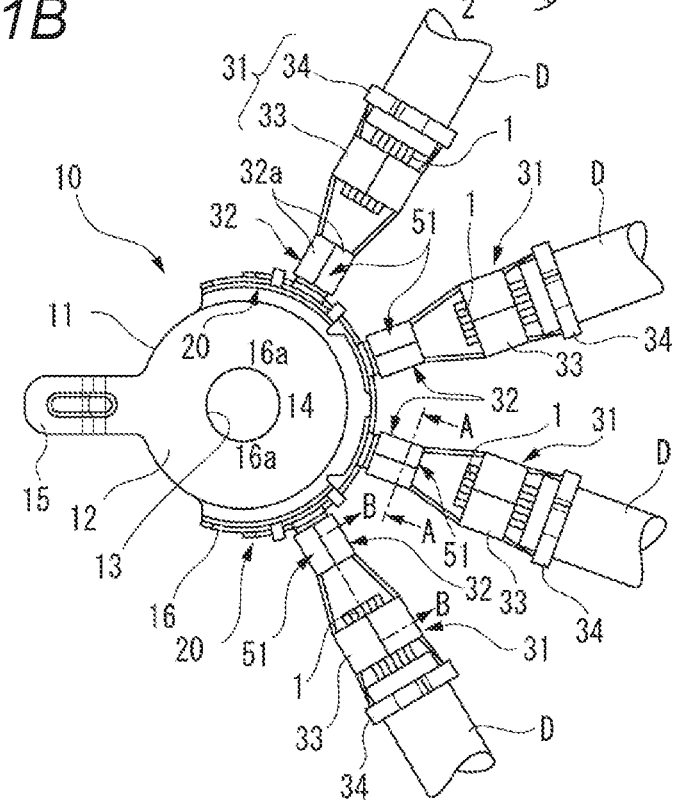
FIG. 1B is a plan view of the terminal fitting to which the grounding electric wires have been connected.

FIGS. 1A and 1B are views for explaining a connection structure of a terminal fitting according to the first embodiment. FIG. 1A is a perspective view of a terminal fitting 10 to which grounding electric wires D have been connected, and FIG. 1B is a plan view of the terminal fitting 10 to which the grounding electric wires D have been connected.

As shown in FIGS. 1A and 1B, terminal connection portions 21 of the terminal fitting 10 and connection terminals 30 are connected in the connection structure of the terminal fitting according to the first embodiment. The terminal fitting 10 is conductively connected to a grounding surface of a body or the like of a vehicle. The connection terminals 30 connected to the terminal fitting 10 are provided in end portions of grounding electric wires (electric wires) D of on-vehicle circuits (accessories). Each grounding electric wire D has a conductor portion 1, and a jacket 2 covering the conductor portion 1. In the end portion where the grounding electric wire D is connected to the connection terminal 30, the conductor portion 1 is exposed from the jacket 2. In the grounding electric wire D, the conductor portion 1 is conductively connected to the connection terminal 30. In this manner, the grounding electric wires D of the on-vehicle circuits are conductively connected to the grounding surface of the body or the like of the vehicle through the terminal fitting 10. For example, 8 sq. mm grounding electric wires D are connected to the connection terminals 30.

Figure 2:
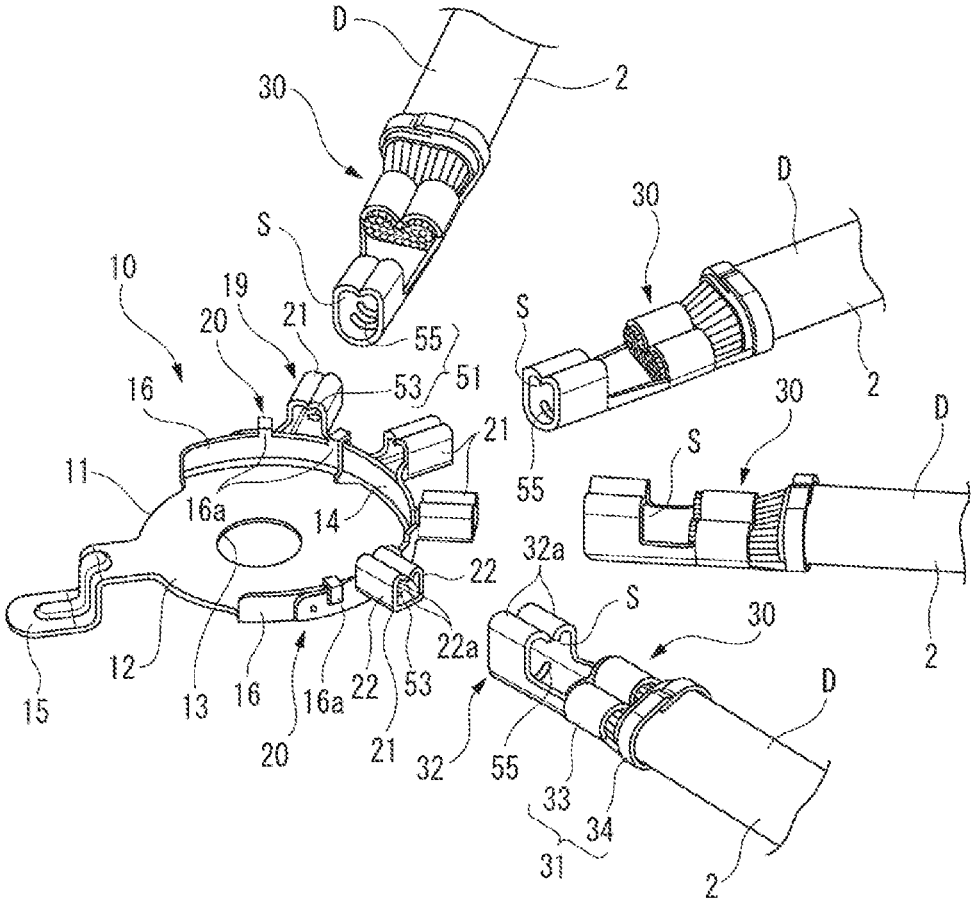
FIG. 2 is a perspective view of the terminal fitting and connection terminals for explaining the connection structure of the terminal fitting according to the first embodiment.
Figure 3A:
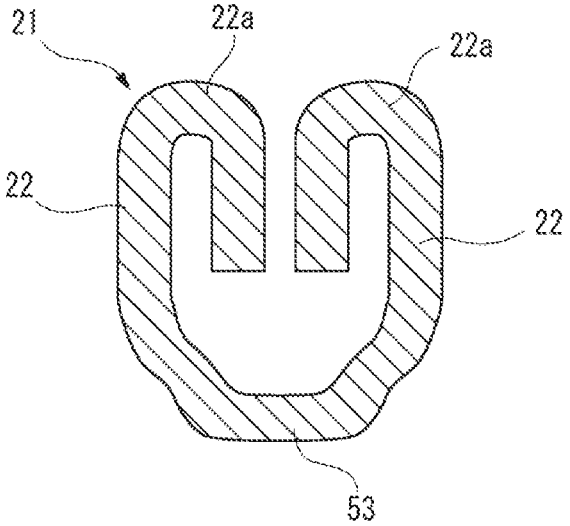
FIGS. 3A and 3B are a cross sectional view and a longitudinal sectional view of a terminal connection portion of the terminal fitting shown in FIG. 2.
Figure 3B:
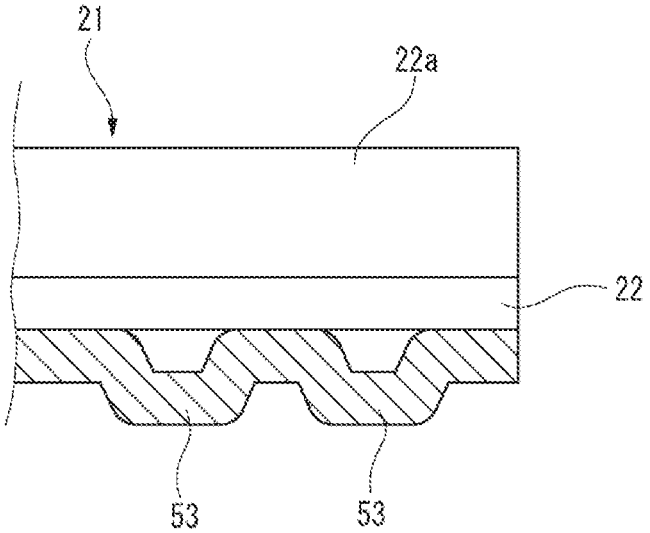
Figure 3C:
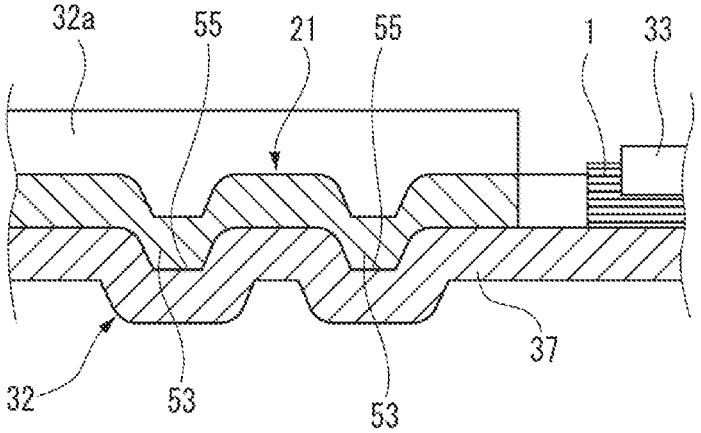
FIG. 3C is a sectional view taken on line B-B in FIG. 1B.

FIG. 2 is a view for explaining the connection structure of the terminal fitting according to the first embodiment. FIGS. 3A and 3B are a cross sectional view and a longitudinal sectional view of a terminal connection portion of the terminal fitting shown in FIG. 2. FIG. 3C is a sectional view taken on line B-B in FIG. 1B.

As shown in FIG. 2, the terminal fitting 10 has a terminal body 11 and an electric wire connection portion body 19 including a plurality of terminal connection portions 21. The terminal fitting 10 is a press-formed article formed out of a conductive metal plate. The terminal body 11 includes a fixed plate portion 12 having a circular shape in planar view. In the fixed plate portion 12, a circular mounting hole 13 is formed at the center thereof. The terminal body 11 is fixed to the grounding surface of the body or the like of the vehicle by a bolt (not shown) inserted into the mounting hole 13 of the fixed plate portion 12. Incidentally, the mounting hole 13 may be provided eccentrically rather than at the center of the fixed plate portion 12.

A rotation stopper piece 15 is formed in a part of the fixed plate portion 12. The rotation stopper piece 15 is a bent portion to be engaged with a step or a hole portion around the grounding surface to which the terminal body 11 is fastened by a bolt. When the rotation stopper piece 15 is engaged with the step or the hole portion around the grounding surface, the rotation stopper piece 15 regulates rotation of the terminal fitting 10 relative to the grounding surface.

Two support wall portions 16 each having an arc shape in planar view are formed at the circumferential edge of the fixed plate portion 12. With respect to the fixed plate portion 12, the support wall portions 16 are provided erectly on the side of the upper surface which is a one-side surface. In addition, in the electric wire connection portion body 19, a connection plate portion 14 having an arc shape in planar view is formed in an approximately half circumferential part of the circumferential edge of the fixed plate portion 12. With respect to the fixed plate portion 12, the connection plate portion 14 is provided erectly on the side of the upper surface which is a one-side surface. The connection plate portion 14 is disposed along the outer circumferential surfaces of the support wall portions 16.

A plurality of lock pieces 16*a* are formed at the upper edge of each support wall portion 16. The lock pieces 16*a* are folded back toward the outer surface of the connection plate portion 14 so that the opposite ends of the connection plate portion 14 can be locked by the lock pieces 16*a*. Thus, the connection plate portion 14 is supported by the support wall portions 16.

In this manner, in the terminal fitting 10, the parts where the connection plate portion 14 is locked by the lock pieces 16*a* of the support wall portions 16 serve as coupling portions 20. That is, the terminal fitting 10 includes a plurality of coupling portions 20 so that the terminal body 11 and the electric wire connection portion body 19 can be coupled with each other by the coupling portions 20.

Each terminal connection portion 21 is formed integrally with the connection plate portion 14 of the terminal body 11. A plurality of terminal connection portions 21 are provided in upper edge parts of the connection plate portion 14. Specifically, four terminal connection portions 21 are formed in the connection plate portion 14. The terminal connection portions 21 are extended, within one and the same plane, from the circumferential edge of the fixed plate portion 12 so as to project radially.

As shown in FIGS. 3A to 3C, each terminal connection portion 21 has engagement walls 22 in its opposite side portions. The engagement walls 22 serve as fastened caulking pieces that project on the side of the upper surface which is a one-side surface. Thus, each terminal connection portion 21 is formed into a U-shape in front view. In addition, each engagement wall 22 has a folded portion 22*a* in its upper end portion. The folded portion 22*a* is bent inward and folded like an arc.

Further, two parallel convex strips 53 extending in the width direction of the terminal connection portion 21 are formed in the bottom portion of the terminal connection portion 21 so as to project outward. The convex strips 53 can be, for example, formed at the same time as the terminal connection portion 21 is formed when the terminal body 11 is pressed.

Figure 4:
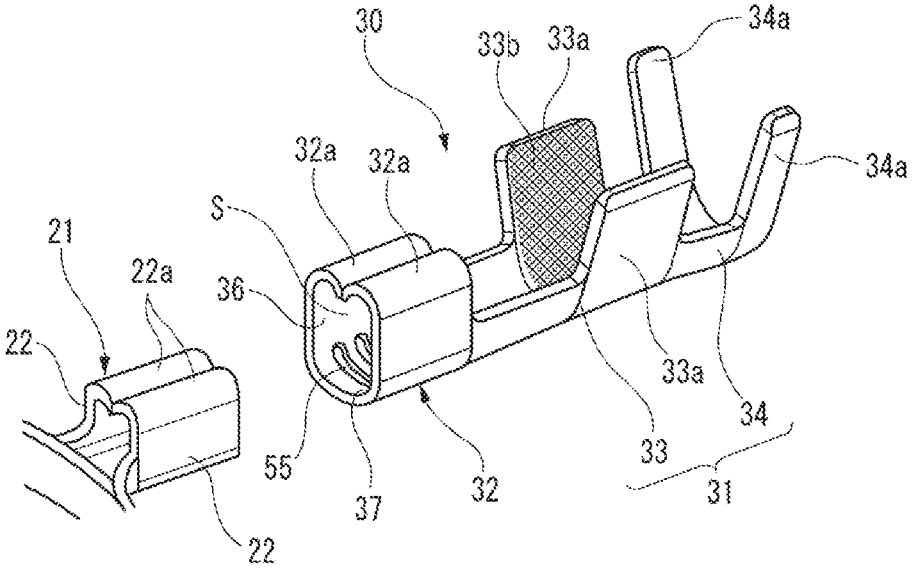
FIG. 4 is a perspective view of a terminal connection portion and a connection terminal.
Figure 5:
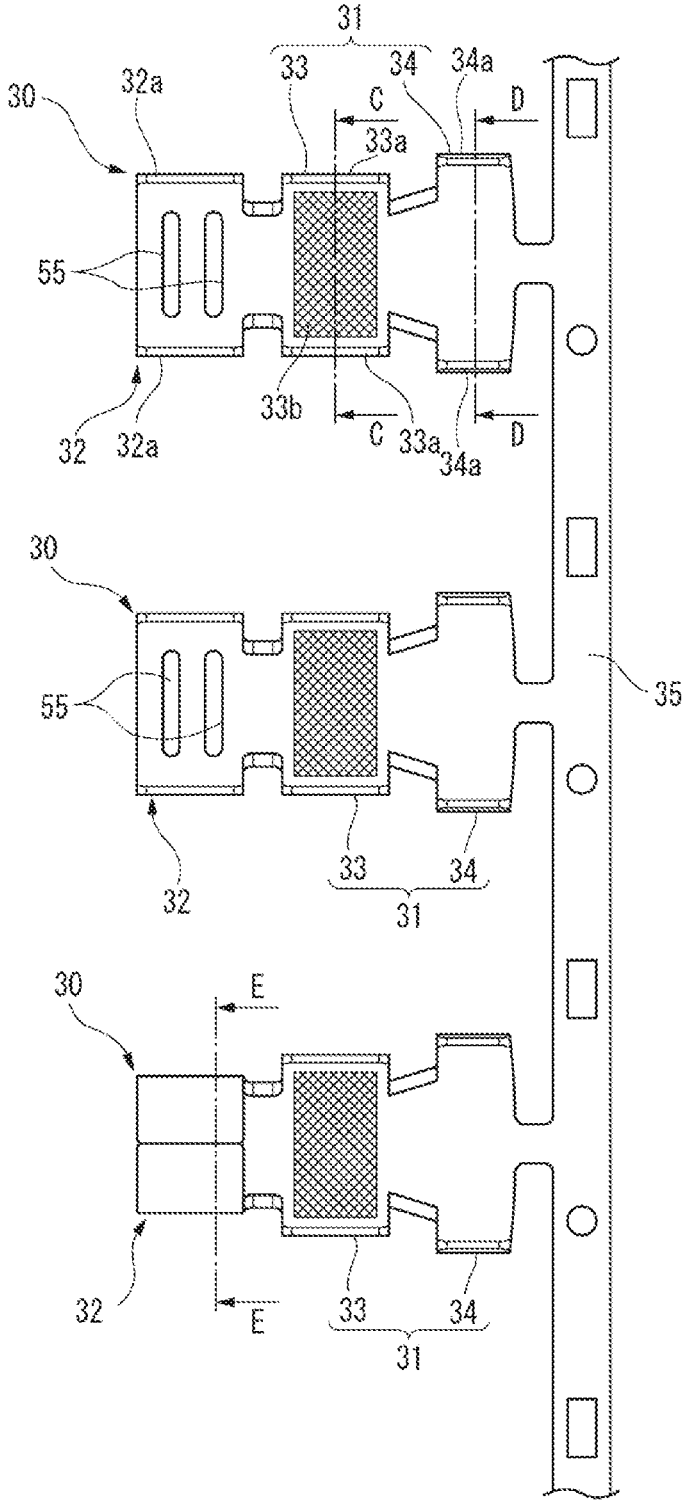
FIG. 5 is a plan view of connection terminals coupled with a carrier.
Figure 6A:
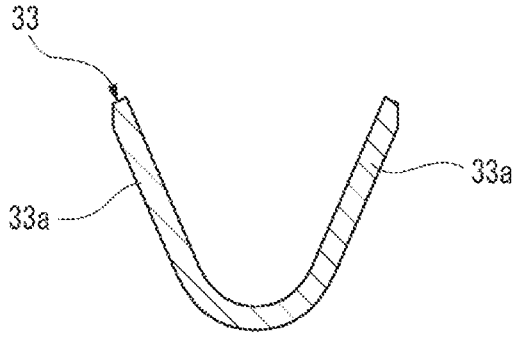
FIGS. 6A to 6C are views for explaining a connection terminal.
Figure 6B:
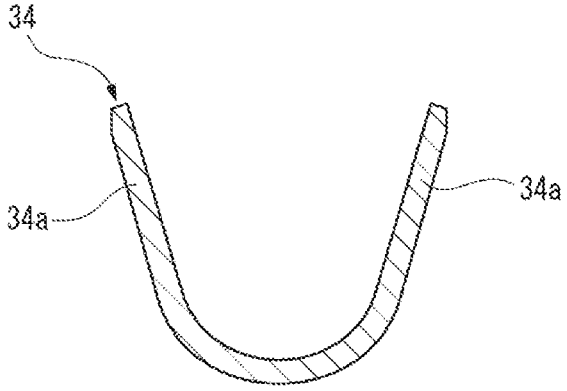
Figure 6C:
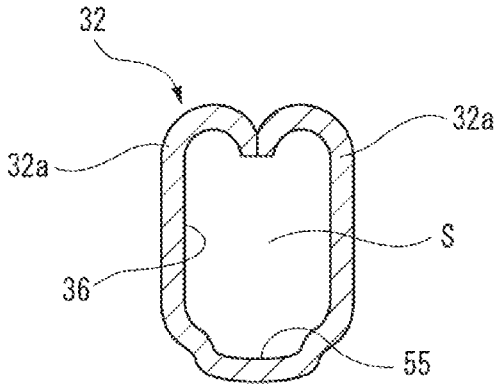

FIG. 4 is a perspective view of a terminal connection portion 21 and a connection terminal 30. FIG. 5 is a plan view of connection terminals 30 coupled with a carrier. FIGS. 6A to 6C are views for explaining a connection terminal 30. FIG. 6A is a sectional view taken on line C-C in FIG. 5. FIG. 6B is a sectional view taken on line D-D in FIG. 5. FIG. 6C is a sectional view taken on line E-E in FIG. 5.

As shown in FIG. 4, each connection terminal 30 has an electric wire connection portion 31 and a fastening connection portion 32. A grounding electric wire D is connected to the electric wire connection portion 31. The connection terminal 30 provided in the grounding electric wire D is a press-formed article formed out of a conductive metal plate. The fastening connection portion 32 is caulked and fastened to one of the terminal connection portions 21 of the terminal fitting 10.

As shown in FIG. 5, the connection terminals 30 are supplied in the state where the connection terminals 30 have been coupled with a belt-like carrier 35 on their electric wire connection portion 31 side. To use each connection terminal 30, the connection terminal 30 is separated from the carrier 35. Each electric wire connection portion 31 has a conductor caulking portion 33 and a coating caulking portion 34.

As shown in FIG. 4 and FIG. 6A, the conductor caulking portion 33 is formed into a U-shape including a pair of conductor caulking pieces 33*a*. When the conductor caulking pieces 33*a* are caulked, the conductor portion 1 of the grounding electric wire D is caulked and fixed to the conductor caulking portion 33. Thus, the conductor portion 1 of the grounding electric wire D is conductively connected to the connection terminal 30. In addition, a rough surface portion (serration) 33*b* that has been roughened by machining is provided in the inner surface of the conductor caulking portion 33. Incidentally, the rough surface portion 33*b* is not limited to the illustrated shape. Thus, the conductor portion 1 of the grounding electric wire D caulked to the conductor caulking portion 33 can be conductively connected to the connection terminal 30 surely.

As shown in FIG. 4 and FIG. 6B, the coating caulking portion 34 is formed into a U-shape including a pair of coating caulking pieces 34*a*. When the coating caulking pieces 34*a* are caulked, the jacket 2 of the grounding electric wire D is caulked and fixed to the coating caulking portion 34.

In order to connect the grounding electric wire D to the connection terminal 30, the jacket 2 is removed to expose the conductor portion 1 in an end portion of the grounding electric wire D. Then, the end portion of the grounding electric wire D is disposed on the electric wire connection portion 31 of the connection terminal 30, and the conductor caulking portion 33 is caulked while the coating caulking portion 34 is caulked. After that, the connection terminal 30 is separated from the carrier 35. Thus, the grounding electric wire D is conductively connected to the connection terminal 30.

As shown in FIG. 4 and FIG. 6C, the fastening connection portion 32 of the connection terminal 30 has a pair of fastening caulking pieces 32*a*. The fastening caulking pieces 32*a* are provided erectly upward from a terminal bottom portion 37 respectively. In addition, the upper end portions of the fastening caulking pieces 32*a* are bent and folded inward in an arc shape. Thus, a retention space S surrounded by the fastening caulking pieces 32*a* is formed in the fastening connection portion 32 of the connection terminal 30. The opposite side faces of the retention space S are formed into substantially vertical faces due to the fastening caulking pieces 32*a* provided erectly upward. The opposite side faces serve as rotation regulation faces 36.

Further, two parallel concave grooves 55 extending in the width direction of the connection terminal 30 are formed in the inner surface of the terminal bottom portion 37 of the fastening connection portion 32. The concave grooves 55 can be, for example, formed at the same time as the fastening connection portion 32 is formed when the connection terminal 30 is pressed.

In addition, when the concave grooves 55 are engaged with the two convex strips 53 formed in the bottom portion of the terminal connection portion 21 correspondingly, a concave-convex engagement portion is formed. The concave-convex engagement portion is provided in the opposed faces where the bottom portion of the terminal connection portion 21 and the terminal bottom portion 37 of the fastening connection portion 32 abut against each other. The concave-convex engagement portion in which the convex strips 53 have been engaged with the concave grooves 55 regulates the terminal connection portion 21 from moving in the insertion direction in which the terminal connection portion 21 has been inserted into the retention space S of the connection terminal 30.

The retention space S of the fastening connection portion 32 is formed to be a little larger than the outer shape of the terminal connection portion 21 in front view. Thus, the terminal connection portion 21 can be inserted into the retention space S (see FIG. 8A). The terminal connection portion 21 inserted into the retention space S abuts against the rotation regulation faces 36 constituted by the opposite side faces forming the retention space S. In this manner, the terminal connection portion 21 can be regulated from rotating around an axis extending in the direction in which the terminal connection portion 21 has been inserted into the retention space S.

Next, description will be made about a case where the connection terminal 30 is caulked and fastened to the terminal connection portion 21 of the terminal fitting 10.

Figure 7:
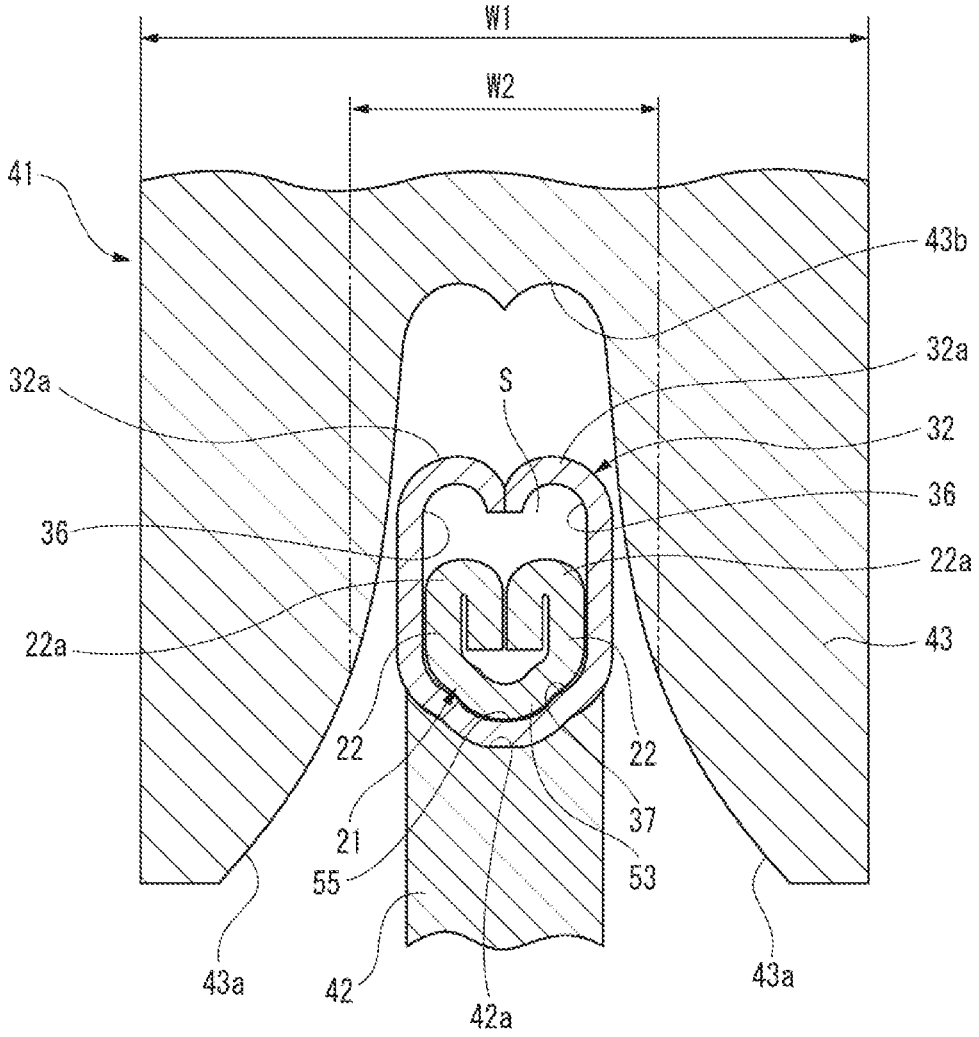
FIG. 7 is a schematic sectional view of a crimping machine in which a connection terminal and a terminal connection portion have been set.
Figure 8A:
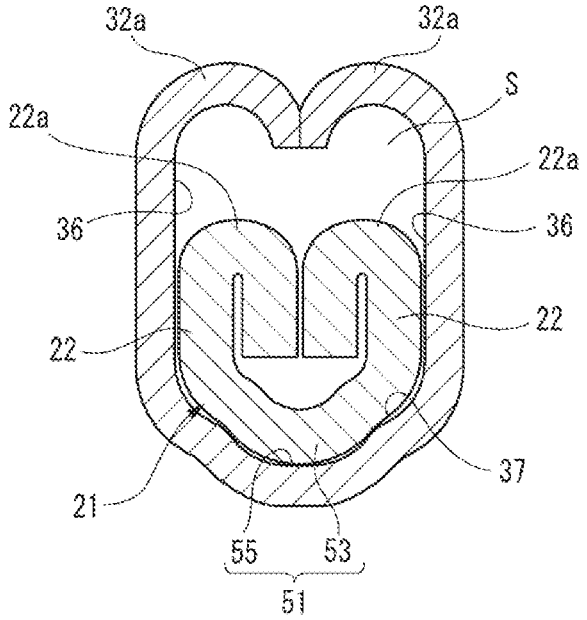
FIGS. 8A to 8C are views each showing a fastening state of fastening caulking pieces of a fastening connection portion to a terminal connection portion of the terminal fitting.
Figure 8B:
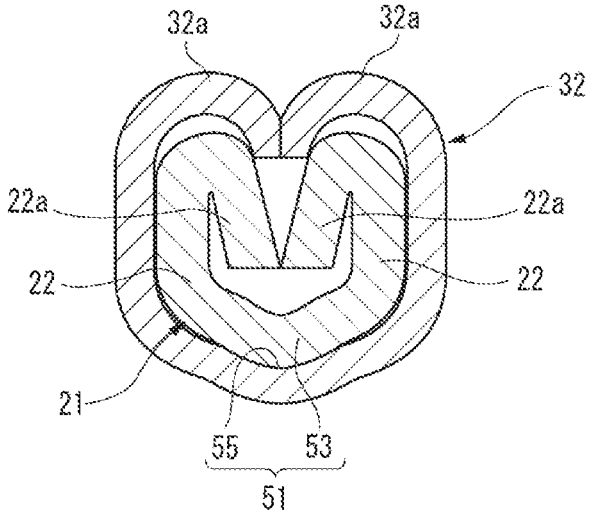
Figure 8C:
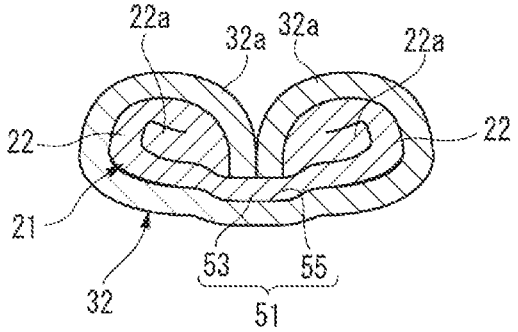

FIG. 7 is a schematic sectional view of a crimping machine 41 in which the connection terminal 30 and the terminal connection portion 21 have been set. FIGS. 8A to 8C are views each showing a fastening state of the fastening caulking pieces 32*a* of the fastening connection portion 32 to the terminal connection portion 21 of the terminal fitting 10. FIG. 8A is a sectional view taken on line A-A in FIG. 1B, showing a state where the fastening caulking pieces 32*a* have not been fastened yet. FIG. 8B is a sectional view taken on line A-A in FIG. 1B, showing a state where the fastening caulking pieces 32*a* are being fastened. FIG. 8C is a sectional view taken on line A-A in FIG. 1B, showing a state where the fastening caulking pieces 32*a* have been fastened.

As shown in FIG. 7, the crimping machine 41 for crimping the connection terminal 30 on the terminal connection portion 21 to thereby caulk and fasten the connection terminal 30 thereto includes an anvil 42, and a crimper 43 that can approach and leave the anvil 42. The top surface of the anvil 42 serves as a mounting face 42*a*. The connection terminal 30 is mounted on the mounting face 42*a*. The mounting face 42*a* is formed into a shape that is recessed slightly downward like an arc. Thus, the connection terminal 30 mounted on the mounting face 42*a* is disposed on the anvil 42. The crimper 43 is formed into a concave shape including guide faces 43*a* spreading gently toward the anvil 42. The crimper 43 has pressing faces 43*b* in an upper portion of its concave part. The pressing faces 43*b* press the fastening caulking pieces 32*a* while guiding the fastening caulking pieces 32*a* toward the inside respectively.

(Temporarily Fixing Step)

As shown in FIG. 8A, first, the connection terminal 30 and the terminal connection portion 21 are temporarily fixed to each other. Specifically, the terminal connection portion 21 is inserted into the retention space S of the connection terminal 30, and the convex strips 53 of the terminal connection portion 21 are engaged with the concave grooves 55 of the connection terminal 30. When the terminal connection portion 21 is thus inserted into the retention space S, the opposite side portions of the terminal connection portion 21 abut against the rotation regulation faces 36 constituted by the opposite side faces of the retention space S. Thus, the terminal connection portion 21 is retained by the fastening connection portion 32 of the connection terminal 30 in the state where the terminal connection portion 21 is regulated from rotating around the axis extending in the insertion direction. In addition, when the convex strips 53 are engaged with the concave grooves 55, the terminal connection portion 21 is regulated from moving in the insertion direction to the retention space S of the connection terminal 30. Thus, the terminal connection portion 21 is kept in a predetermined posture and a predetermined position with respect to the connection terminal 30.

(Mounting Step)

As shown in FIG. 7, the connection terminal 30 temporarily fixing the terminal connection portion 21 is mounted on the mounting face 42*a* of the anvil 42 of the crimping machine 41. In this state, the terminal connection portion 21 is still inserted into the retention space S while engagement is established between the concave grooves 55 and the convex strips 53. Therefore, the terminal connection portion 21 is regulated from rotating around the axis extending in the insertion direction and moving in the insertion direction, so that the terminal connection portion 21 can be kept in the predetermined posture and the predetermined position with respect to the connection terminal 30.

(Fastening Step)

The crimping machine 41 is actuated to start crimping and move down the crimper 43 of the crimping machine 41. Thus, the fastening connection portion 32 is guided into the concave part by the guide faces 43*a* of the crimper 43. Still on this occasion, the terminal connection portion 21 is kept in the predetermined posture and the predetermined position inside the retention space S with respect to the connection terminal 30. After that, the pressing faces 43*b* of the crimper 43 abut against the upper portions of the fastening caulking pieces 32*a* of the fastening connection portion 32. As a result, the fastening caulking pieces 32*a* are crushed to start caulking.

Then, as shown in FIG. 8B, the fastening caulking pieces 32*a* catch the opposite side portions of the terminal connection portion 21. After that, the fastening caulking pieces 32*a* are caulked to catch the engagement walls 22 of the terminal connection portion 21 and the engagement pieces 22*a* at the upper ends of the engagement walls 22 from outside.

Thus, as shown in FIG. 8C, the engagement walls 22 including the engagement pieces 22*a* are rounded inside the fastening caulking pieces 32*a* and received therein tightly so that the fastening connection portion 32 can be filled with the terminal connection portion 21. Accordingly, the fastening connection portion 32 is caulked and fastened to the terminal connection portion 21 firmly with high contact pressure, while the terminal fitting 10 and the connection terminal 30 are conductively connected surely.

Further, the concave-convex engagement portion constituted by the convex strips 53 and the concave grooves 55 is provided in the bottom portion of the terminal connection portion 21 and the terminal bottom portion 37 of the fastening connection portion 32 so that the terminal connection portion 21 can be prevented from coming out from the fastening caulking pieces 32*a*. That is, when the fastening connection portion 32 is caulked and fastened to the terminal connection portion 21, the terminal connection portion 21 whose bottom portion is made unable to leave the terminal bottom portion 37 of the fastening connection portion 32 cannot detach the convex strips 53 from the concave grooves 55.

Thus, as shown in FIG. 3C and FIG. 8C, the convex strips 53 and the concave grooves 55 fitted to each other in a direction (plate thickness direction of the terminal bottom portion 37) perpendicular to the insertion direction of the terminal connection portion 21 to the fastening connection portion 32 can firmly prevent the terminal connection portion 21 from coming out from the fastening caulking pieces 32*a*.

When the terminal connection portions 21 of the terminal fitting 10 and the connection terminals 30 are fastened and connected in the aforementioned steps, the grounding electric wires D are conductively connected to the terminal fitting 10 in a lump. When the terminal fitting 10 is fixed to the grounding surface of the vehicle by a bolt, the grounding electric wires D are grounded.

As has been described above, according to the connection structure of the terminal fitting according to the first embodiment, the terminal connection portion 21 is inserted into the retention space S surrounded by the fastening caulking pieces 32*a* of the connection terminal 30 so that the terminal connection portion 21 can be retained by the connection terminal 30. Thus, the fastening caulking pieces 32*a* can be caulked and fastened in the state where the terminal connection terminal 21 has been retained by the connection terminal 30. As a result, the terminal connection portion 21 can be kept in a stable posture when it is being fastened. Thus, a variation in crimping strength can be suppressed to obtain high reliability in connection.

In addition, according to the connection structure of the terminal fitting according to the first embodiment, the terminal connection portion 21 is inserted into and retained by the retention space S formed in advance in the connection terminal 30, and the fastening caulking pieces 32*a* are crushed and fastened to caulk and catch the outer sides of the opposite side portions of the terminal connection portion 21 inside the retention space S. Thus, the fastening work can be performed in the state where the posture of the terminal connection portion 21 has been stabilized with respect to the connection terminal 30. In this manner, the workability can be improved, and a variation in crimping strength can be suppressed to obtain high reliability in connection. In addition, due to the retention space S formed in advance in the connection terminal 30, the width size can be suppressed in comparison with a case where the fastening caulking pieces 32*a* are formed into a U-shape widened upward. Thus, components including the crimper 43 can be miniaturized to save the working space during fastening by the crimping machine 41. For example, as shown in FIG. 7, in comparison with the case where fastening caulking pieces formed into a U-shape widened upward are caulked, the guide faces 43*a* can be made so small that the width size of the crimper 43 can be set at W2, which is much smaller than W1.

In addition, the terminal connection portion 21 inserted into the retention space S is retained by the connection terminal 30 in the state where the terminal connection portion 21 is regulated from rotating around the axis extending in the insertion direction by the rotation regulation faces 36 constituted by the opposite side faces of the retention space S. Thus, the terminal connection portion 21 can be kept in a more stable posture with respect to the connection terminal 30, so that the accuracy of caulking and fastening can be enhanced.

In addition, according to the first embodiment, when a plurality of grounding electric wires D are connected to the terminal fitting 10, the grounding electric wires D can be conductively connected to the terminal fitting 10 in a lump. It is therefore unnecessary to stack terminal fittings 10. Accordingly, in comparison with a background-art structure in which terminal fittings connected to grounding electric wires respectively are stacked and fastened for conductive connection, increase in weight of the terminal fitting 10 can be suppressed even when the number of grounding electric wires D increases. In addition, since it is not necessary to stack terminal fittings 10, the thickness of the terminal fitting 10 does not increase even when the number of electric wires D to be conductively connected increases. Thus, space saving can be attained. In addition, since the connection terminals 30 are fastened to the terminal connection portions 21 of the terminal fitting 10, it is possible to dispense with a special holding mechanism for holding the connection terminals 30. Thus, reduction in size and cost can be attained in comparison with a joint connector in which a holding mechanism for holding terminals has to be provided in a housing.

In addition, due to the structure in which separate connection terminals 30 are fastened and connected to the terminal fitting 10, the connection terminals 30 to which grounding electric wires D different in size have been connected can be fastened and conductively connected to the terminal connection portions 21. That is, grounding electric wires D having various sizes can be dealt with without changing the connection forms between the terminal connection portions 21 of the terminal fitting 10 and the fastening connection portions 32 of the connection terminals 30. In addition, when terminal fittings 10 differing in number of terminal connection portions 21 are prepared, it is possible to easily deal with increase or decrease in number of grounding electric wires D to be conductively connected.

Here, for example, a plurality of grounding electric wires D can be conductively connected in a lump in a terminal fitting in which a plurality of connection portions to which the grounding electric wires D can be connected are formed integrally. However, such a terminal fitting has to be prepared in accordance with the number of grounding electric wires D to be connected. In addition, a terminal fitting having connection portions corresponding to the grounding electric wires D has to be prepared in accordance with a change in size of the grounding electric wires D.

On the other hand, according to the connection structure of the terminal fitting according to the first embodiment, a change in number or size of grounding electric wires D to be conductively connected can be dealt with by a required minimum variation of terminal fittings 10.

In addition, due to the structure in which connection terminals 30 are caulked and fastened to a plurality of terminal connection portions 21 of the terminal fitting 10, the connection terminals 30 can be fastened to the terminal connection portions 21 in accordance with necessity. Thus, the number of grounding electric wires D to be conductively connected in a lump can be increased or decreased easily within the range of the number of terminal connection portions 21.

In addition, the engagement walls 22 that can be engaged with the fastening caulking pieces 32*a* are formed in the opposite side portions of the terminal connection portion 21. Accordingly, when the fastening caulking pieces 32*a* of the connection terminal 30 are caulked to the terminal connection portion 21, the fastening caulking pieces 32*a* are engaged with the engagement walls 22 of the terminal connection portion 21. Thus, the fastening caulking pieces 32*a* are surely crimped on the terminal connection portion 21 so that the connection strength of the connection terminal 30 to the terminal connection portion 21 can be further enhanced. It is therefore possible to stabilize electric resistance at the connection place to thereby improve the electric connection.

Particularly, the engagement pieces 22*a* folded inward are formed at the upper ends of the engagement walls 22 of the terminal connection portion 21. Accordingly, the fastening caulking pieces 32*a* are surely crimped on the terminal connection portion 21 so that the engagement force with the fastening caulking pieces 32*a* of the connection terminal 30 can be further enhanced. Thus, high connection strength can be obtained surely. It is therefore possible to stabilize electric resistance at the connection place to thereby improve the electric connection.

Further, in the connection structure of the terminal fitting according to the first embodiment, the convex strips 53 and the concave grooves 55 establishing concave-convex engagement are provided in the bottom portion of the terminal connection portion 21 and the terminal bottom portion 37 of the fastening connection portion 32. Accordingly, the terminal connection portion 21 can be surely prevented from coming out from the fastening caulking pieces 32*a*. Thus, reliability in mechanical connection is improved in comparison with a structure in which connection is established only by caulking and fastening of the fastening connection portion 32.

In addition, in the connection structure of the terminal fitting according to the first embodiment, the concave grooves 55 extending in the width direction of the terminal bottom portion 37 are engaged with the convex strips 53 extending in the width direction of the caulked terminal connection portion 21. Accordingly, the engagement margin of the concave-convex engagement portion can be increased. Thus, the terminal connection portion can be surely prevented from coming out from the fastening caulking pieces.

In addition, the convex strips 53 and the concave grooves 55 in the first embodiment can be formed easily in the terminal connection portion 21 and the connection terminal 30 by press working. Thus, increase in working cost can be suppressed.

In addition, the terminal connection portions 21 are extended radially within one and the same plane. Accordingly, it is possible to provide a large number of terminal connection portions 21 while suppressing the area occupied by the terminal fitting 10 as much as possible. Thus, a large number of grounding electric wires D can be connected in a lump.

In addition, in the connection structure of the terminal fitting according to the first embodiment, the electric wire connection portion body 19 coupled with the terminal body 11 through the coupling portions 20 is separated for the sake of disassembly. In this manner, the grounding electric wires D can be separated from the terminal body 11 in a lump. Thus, good recycling efficiency can be obtained.

In addition, the locking force with which the coupling portions 20 coupling the terminal body 11 with the electric wire connection portion body 19 are locked by the locking pieces 16*a* can be adjusted. For example, the locking force can be adjusted in accordance with the diameters of grounding electric wires D, the number of the grounding electric wires D to be connected, the wiring condition of the grounding electric wires D, etc. Thus, connection strength during wiring can be secured surely while good separation performance during disassembly can be also secured. Thus, durability and recycling efficiency can be made compatible. For example, the coupling strength between the terminal body 11 and the electric wire connection portion body 19 can be adjusted within a range from strength required as connection strength to strength allowing separation (for example, from 100 N to 500 N).

Incidentally, as the terminal connection portion 21 in the aforementioned first embodiment, the engagement walls 22 provided in the opposite side portions are formed into concave shapes in section, and the engagement pieces 22*a* bent inward and folded like an arc are formed in the upper end portions of the engagement walls 22. However, the sectional shape of the terminal connection portion 21 is not limited to the aforementioned one. For example, the sectional shape may be formed into a V-shape.

In addition, the first embodiment has been described along an example in which the terminal fitting 10 including four terminal connection portions 21 is used. However, the number of terminal connection portions 21 in the terminal fitting 10 is not limited to four as long as it is plural.

Further, in the first embodiment, concave-convex engagement is established by a configuration in which the convex strips 53 serving as convex engagement portions protruding outward are formed in the bottom portion of the terminal connection portion 21, and the concave grooves 55 serving as concave engagement portions are formed in the inter surface of the terminal bottom portion 37 of the fastening connection portion 32. However, the concave-convex engagement portion according to the invention are not limited to the configuration. The concave-convex engagement portion may have another configuration in which convex engagement portions protruding inward are formed in the bottom portion of the terminal connection portion 21, and concave engagement portions are formed in the outer surface of the terminal bottom portion 37 of the fastening connection portion 32. Not to say, the shapes of the convex engagement portions and the concave engagement portions can take various shapes.

That is, as the concave-convex engagement portion provided in the opposed surfaces where the bottom portion of the terminal connection portion 21 and the terminal bottom portion 37 of the fastening connection portion 32 abut against each other respectively, various forms may be taken as long as the terminal connection portion 21 can be regulated from moving in the insertion direction to the fastening connection portion 32.

Second Embodiment

Next, description will be made about a connection structure of a terminal fitting according to a second embodiment of the invention.

Incidentally, parts of the connection structure other than connection terminals are substantially the same as those in the first embodiment. Therefore, those parts are referenced correspondingly, and description thereof will be omitted.

Figure 9A:
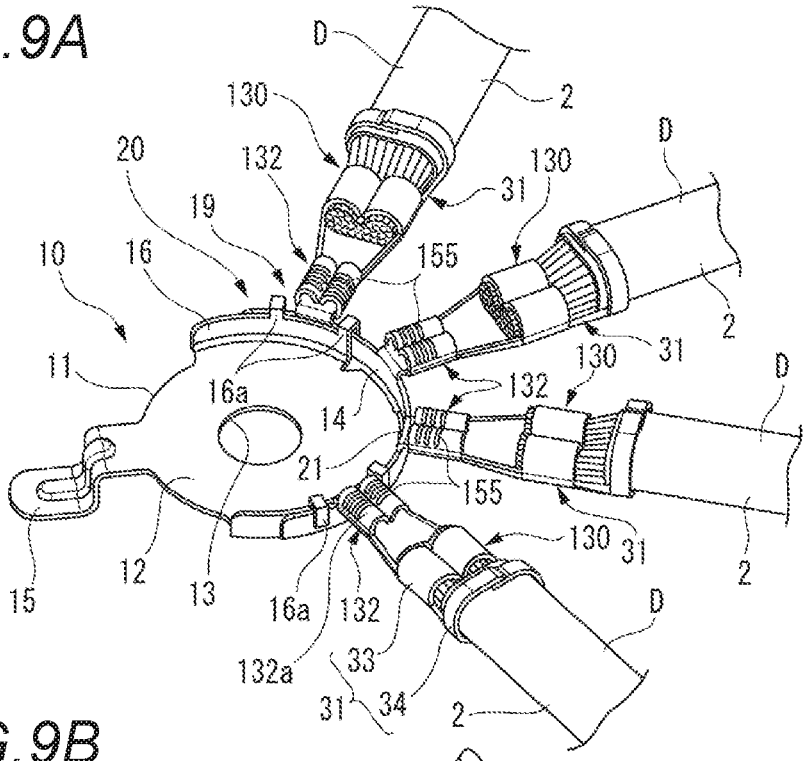
FIG. 9A is a perspective view of the terminal fitting to which grounding electric wires have been connected.
Figure 9B:
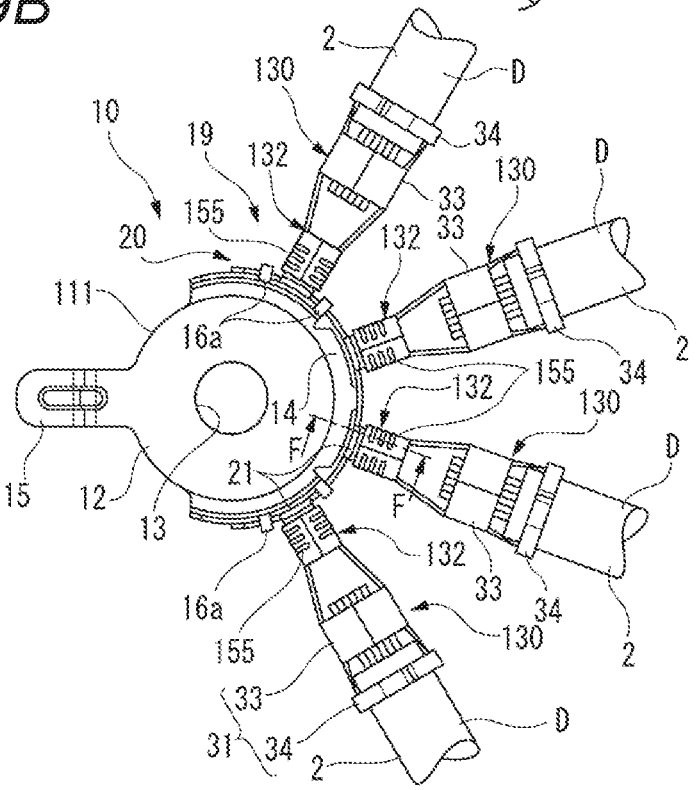
FIG. 9B is a plan view of the terminal fitting to which the grounding electric wires have been connected.
Figure 10:
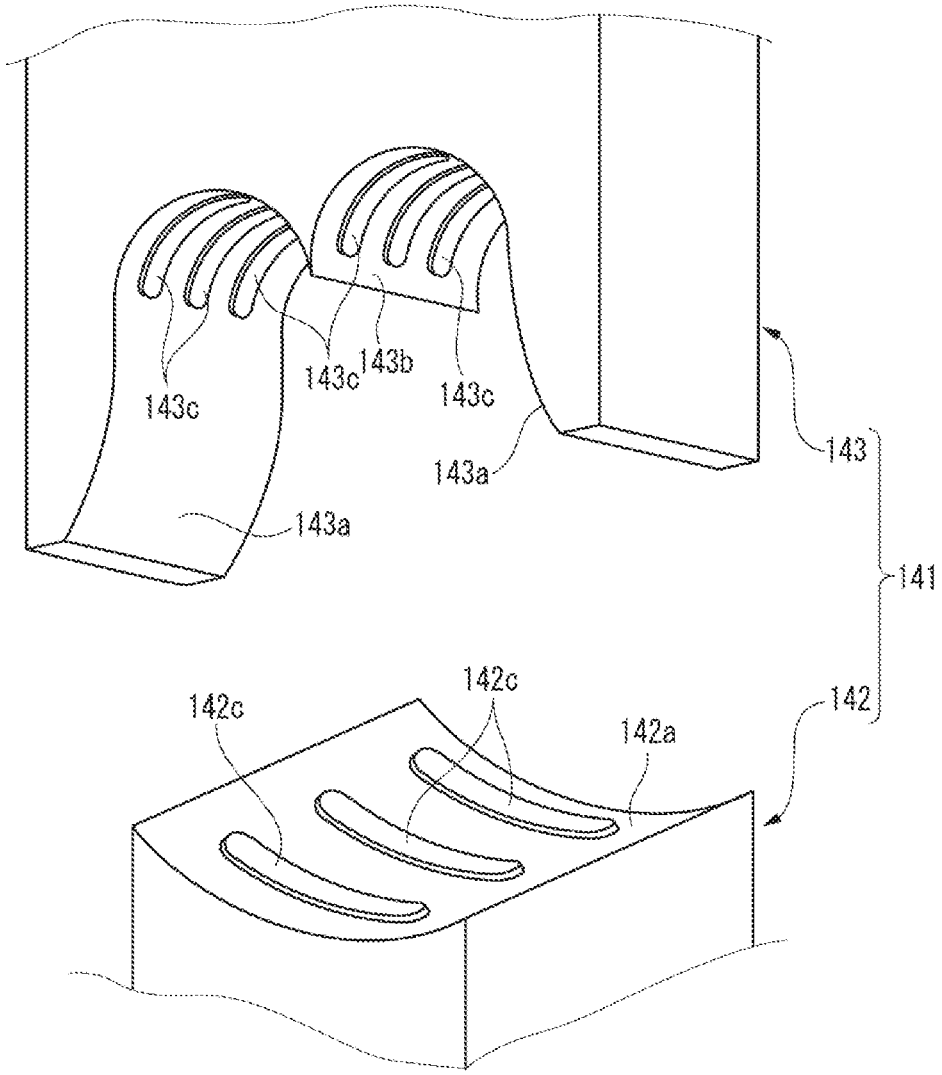
FIG. 10 is a schematic perspective view of a crimping machine for explaining the connection method for the terminal fitting according to the second embodiment.

FIGS. 9A and 9B are views for explaining the connection structure of the terminal fitting according to the second embodiment. FIG. 9A is a perspective view of a terminal fitting 10 to which grounding electric wires D have been connected, and FIG. 9B is a plan view of the terminal fitting 10 to which the grounding electric wires D have been connected. FIG. 10 is a schematic perspective view of a crimping machine for explaining a connection method for the terminal fitting 10 according to the second embodiment.

As shown in FIGS. 9A and 9B, the terminal fitting 10 is connected to connection terminals 130 in the connection structure of the terminal fitting according to the second embodiment. The terminal fitting 10 is also conductively connected to a grounding surface of a body or the like of a vehicle. Thus, grounding electric wires D of on-vehicle circuits are conductively connected to the grounding surface of the body or the like of the vehicle through the terminal fitting 10.

Figure 11A:
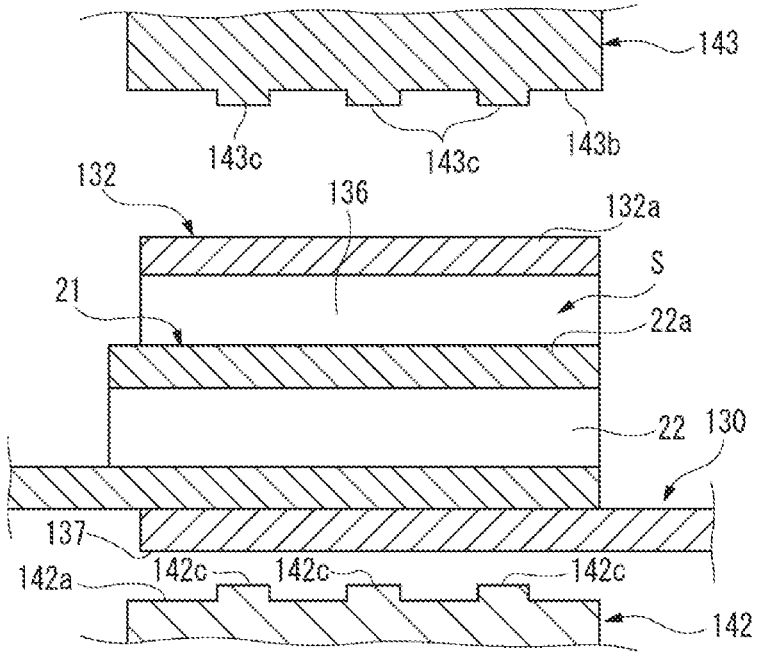
FIGS. 11A to 11C are views each showing a fastening state of fastening caulking pieces of a fastening connection portion to a terminal connection portion of the terminal fitting.
Figure 11B:
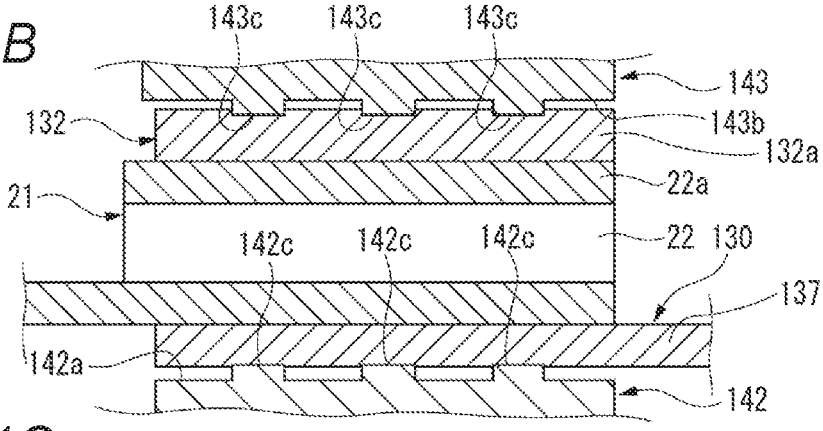
Figure 11C:
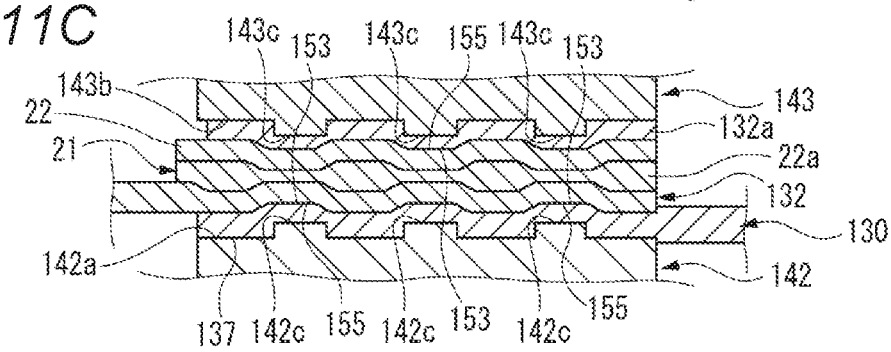

FIGS. 11A to 11C are views each showing a fastening state of fastening caulking pieces 132*a* of a fastening connection portion 132 to a terminal connection portion 21 of the terminal fitting 10. FIG. 11A is a sectional view taken on line F-F in FIG. 9B, showing a state where the fastening caulking pieces 132*a* have not been fastened yet. FIG. 11B is a sectional view taken on line F-F in FIG. 9B, showing a state where the fastening caulking pieces 132*a* are being fastened. FIG. 11C is a sectional view taken on line F-F in FIG. 9B, showing a state where the fastening caulking pieces 132*a* have been fastened.

As shown in FIGS. 9A and 9B, the terminal fitting 10 has a terminal body 11, and an electric wire connection portion body 19 including a plurality of terminal connection portions 21. The connection terminals 130 to be connected to the terminal fitting 10 are provided in end portions of the grounding electric wires D of on-vehicle circuits (accessories).

The connection terminals 130 are supplied in the state where the connection terminals 130 have been coupled with a belt-like carrier on their electric wire connection portion 31 side. To use each connection terminal 130, the connection terminal 130 is separated from the carrier. Each electric wire connection portion 31 has a conductor caulking portion 33 and a coating caulking portion 34.

The fastening connection portion 132 of the connection terminal 130 has a pair of fastening caulking pieces 132*a*. The fastening caulking pieces 132*a* are provided erectly upward from a terminal bottom portion 137 respectively. In addition, the upper end portions of the fastening caulking pieces 132*a* are bent and folded inward in an arc shape.

Thus, a retention space S surrounded by the fastening caulking pieces 132*a* is formed in the fastening connection portion 132 of the connection terminal 130. The opposite side faces of the retention space S are formed into substantially vertical faces due to the fastening caulking pieces 132*a* provided erectly upward. The opposite side faces serve as rotation regulation faces 136 (see FIGS. 11A to 11C).

The retention space S of the fastening connection portion 132 is formed to be a little larger than the outer shape of the terminal connection portion 21 in front view. Thus, the terminal connection portion 21 can be inserted into the retention space S (see FIG. 11A). The terminal connection portion 21 inserted into the retention space S abuts against the rotation regulation faces 136 constituted by the opposite side faces forming the retention space S. In this manner, the terminal connection portion 21 can be regulated from rotating around an axis extending in the direction in which the terminal connection portion 21 has been inserted into the retention space S.

Next, description will be made about a case where the connection terminal 130 is caulked and fastened to the terminal connection portion 21 of the terminal fitting 10.

FIG. 10 is a schematic sectional view of a crimping machine 141 in which the connection terminal 130 and the terminal connection portion 21 will be set. FIGS. 11A to 11C are views each showing a fastening state of the fastening caulking pieces 132*a* of the fastening connection portion 132 to the terminal connection portion 21 of the terminal fitting 10. FIG. 11A is a sectional view taken on line F-F in FIG. 9B, showing a state where the fastening caulking pieces 132*a* have not been fastened yet. FIG. 11B is a sectional view taken on line F-F in FIG. 9B, showing a state where the fastening caulking pieces 132*a* are being fastened. FIG. 11C is a sectional view taken on line F-F in FIG. 9B, showing a state where the fastening caulking pieces 132*a* have been fastened.

As shown in FIG. 10, the crimping machine 141 for crimping the connection terminal 130 on the terminal connection portion 21 to thereby caulk and fasten the connection terminal 130 thereto includes an anvil 142, and a crimper 143 that can approach and leave the anvil 142.

The top surface of the anvil 142 serves as a mounting face 142*a*. The connection terminal 130 is mounted on the mounting face 142*a*. Protruding strips 142*c* like straight lines are provided to protrude in the mounting face 142*a* in the state where the protruding strips 142*c* are arranged in the front/rear direction crossing the axial direction of the connection terminal 130 to be mounted on the mounting face 142*a*.

The crimper 143 is formed into a concave shape including guide faces 143*a* spreading gently toward the anvil 142. The crimper 143 has pressing faces 143*b* in an upper portion of its concave part. The pressing faces 143*b* press the fastening caulking pieces 132*a* while guiding the fastening caulking pieces 132*a* toward the inside respectively. Protruding strips 143*c* like straight lines are provided to protrude in the pressing face 143*b* in the state where the protruding strips 143*c* are arranged in the front/rear direction crossing the axial direction of the connection terminal 130.

(Temporarily Fixing Step)

As shown in FIG. 11A, first, the connection terminal 130 and the terminal connection portion 21 are temporarily fixed to each other. Specifically, the terminal connection portion 21 is inserted into the retention space S of the connection terminal 130. When the terminal connection portion 21 is thus inserted into the retention space S, the opposite side portions of the terminal connection portion 21 abut against the rotation regulation faces 136 constituted by the opposite side faces of the retention space S. Thus, the terminal connection portion 21 is retained by the fastening connection portion 132 of the connection terminal 130 in the state where the terminal connection portion 21 is regulated from rotating around the axis extending in the insertion direction. Thus, the terminal connection portion 21 is kept in a predetermined posture with respect to the connection terminal 130.

(Mounting Step)

Next, the connection terminal 130 temporarily fixing the terminal connection portion 21 is mounted on the mounting face 142*a* of the anvil 142 of the crimping machine 141. In this state, the terminal connection portion 21 is still inserted into the retention space S. Therefore, the terminal connection portion 21 is regulated from rotating around the axis extending in the insertion direction, so that the terminal connection portion 21 can be kept in the predetermined posture with respect to the connection terminal 130.

(Fastening Step)

The crimping machine 141 is actuated to start crimping and move down the crimper 143 of the crimping machine 141. Thus, the fastening connection portion 132 is guided into the concave part by the guide faces 143*a* of the crimper 143. Still on this occasion, the terminal connection portion 21 is kept in the predetermined posture inside the retention space S with respect to the connection terminal 130. After that, the pressing faces 143*b* of the crimper 43 abut against the upper portions of the fastening caulking pieces 132*a* of the fastening connection portion 132. As a result, the fastening caulking pieces 132*a* are crushed to start caulking.

Then, the fastening caulking pieces 132*a* catch the opposite side portions of the terminal connection portion 21. After that, the fastening caulking pieces 132*a* are caulked to catch the engagement walls 22 of the terminal connection portion 21 and the engagement pieces 22*a* at the upper ends of the engagement walls 22 from outside. At the same time, as shown in FIG. 11B, the protruding strips 143*c* provided to protrude in the pressing faces 143*b* of the crimper 143 eat into the upper faces of the fastening caulking pieces 132*a*, and the protruding strips 142*c* provided to protrude in the mounting face 142*a* of the anvil 142*a* eat into the lower face of the terminal bottom portion 137 in the fastening connection portion 132.

When the crimper 143 of the crimping machine 141 is further moved down, as shown in FIG. 11C, the engagement walls 22 including the engagement pieces 22*a* are rounded inside the fastening caulking pieces 132*a* and received therein tightly so that the fastening connection portion 132 can be filled with the terminal connection portion 21. Accordingly, the fastening connection portion 132 is caulked and fastened to the terminal connection portion 21 firmly with high contact pressure, while the terminal fitting 10 and the connection terminal 130 are conductively connected surely.

Further, in the opposed faces abutting against the terminal connection portion 21 in the terminal bottom portion 137 and the fastening caulking pieces 132*a* of the fastening connection portion 132, protruding strips 153 serving as convex engagement portions are formed by the protruding strips 142*c* of the anvil 142 and the protruding strips 143*c* of the crimper 143 when the fastening caulking pieces 132*a* of the connection terminal 130 are crushed and caulked. Concave grooves 155 serving as concave engagement portions are formed in the outer surface of the terminal connection portion 21 opposed to the convex strips 153. Accordingly, the convex strips 153 and the concave grooves 155 are engaged with each other so that the connection terminal 130 can have concave-convex engagement with the terminal connection portion 21. Thus, the terminal connection portion 21 is prevented from coming out from the fastening caulking pieces 132*a*. That is, the fastening connection portion 132 is caulked and fastened to the terminal connection portion 21, so that concave-convex engagement can be established between the fastening connection portion 132 and the terminal connection portion 21. Thus, the terminal connection portion 21 cannot be detached from the fastening connection portion 132.

Thus, as shown in FIG. 11C, the convex strips 153 and the concave grooves 155 fitted to each other in a direction (plate thickness direction of the terminal bottom portion 137) perpendicular to the insertion direction of the terminal connection portion 21 to the fastening connection portion 132 can firmly prevent the terminal connection portion 21 from coming out from the fastening caulking pieces 132*a*.

When the terminal connection portions 21 of the terminal fitting 10 and the connection terminals 130 are fastened and connected in the aforementioned steps, the grounding electric wires D are conductively connected to the terminal fitting 10 in a lump. When the terminal fitting 10 is fixed to the grounding surface of the vehicle by a bolt, the grounding electric wires D are grounded.

As has been described above, according to the connection method for the terminal fitting according to the second embodiment, the terminal connection portion 21 is inserted into the retention space S surrounded by the fastening caulking pieces 132*a* of the connection terminal 130 so that the terminal connection portion 21 can be retained by the connection terminal 130. Thus, the fastening caulking pieces 132*a* can be caulked and fastened in the state where the terminal connection terminal 21 has been retained by the connection terminal 130. As a result, the terminal connection portion 21 can be kept in a stable posture when it is being caulked and fastened. Thus, a variation in crimping strength can be suppressed to obtain high reliability in connection.

In addition, the fastening work can be performed in the state where the posture of the terminal connection portion 21 has been stabilized with respect to the connection terminal 130. Thus, the workability can be improved, and a variation in crimping strength can be suppressed to obtain high reliability in connection. In addition, due to the retention space S formed in advance in the connection terminal 130, the width size can be suppressed in comparison with a case where the fastening caulking pieces 132*a* are formed into a U-shape widened upward. Thus, components including the crimper 143 can be miniaturized to save the working space during fastening by the crimping machine 141.

In addition, also in the connection method for the terminal fitting according to the second embodiment, the connection terminals 130 connected to a plurality of grounding electric wires D are caulked and fastened to the terminal connection portions 21 of the terminal fitting 10, so that the grounding electric wires D can be conductively connected to the terminal fitting 10 in a lump surely and with high reliability in connection.

In addition, in the same manner as in the first embodiment, when the fastening caulking pieces 132*a* of the connection terminals 130 connected to a plurality of grounding electric wires D are caulked to the terminal connection portions 21 provided in the terminal fitting 10, the connection terminals 130 can be fastened to the terminal fitting 10 to thereby conductively connect the grounding electric wires D to the terminal fitting 10 in a lump. It is therefore unnecessary to stack terminal fittings 10. Accordingly, in comparison with a structure in which terminal fittings connected to electric wires respectively are stacked and fastened for conductive connection, increase in weight of the terminal fitting can be suppressed even when the number of electric wires increases. In addition, since it is not necessary to stack terminal fittings, thickness does not increase even when electric wires to be conductively connected increases. Thus, space saving can be attained. In addition, since the connection terminals 130 are fastened to the terminal connection portions 21 of the terminal fitting 10, it is possible to dispense with a special holding mechanism for holding the connection terminals 130. Thus, reduction in size and cost can be attained in comparison with a joint connector in which a holding mechanism for holding terminals has to be provided in a housing.

In addition, since separate connection terminals 130 are fastened and connected to the terminal fitting 10, the connection terminals 130 to which grounding electric wires D different in size have been connected can be caulked and fastened to the terminal connection portions 21 to be thereby conductively connected thereto. That is, grounding electric wires D having various sizes can be dealt with without changing the connection forms between the terminal connection portions 21 of the terminal fitting 10 and the fastening connection portions 32 of the connection terminals 130. In addition, when terminal fittings 10 differing in number of terminal connection portions 21 are prepared, it is possible to easily deal with increase or decrease in number of grounding electric wires D to be conductively connected.

That is, also in the connection method for the terminal fitting according to the second embodiment, a change in number or size of grounding electric wires D to be conductively connected can be dealt with by a required minimum variation of terminal fittings 10.

In addition, since the connection terminals 130 are caulked and fastened to a plurality of terminal connection portions 21 of the terminal fitting 10, the connection terminals 130 can be caulked and fastened to the terminal connection portions 21 in accordance with necessity. Thus, the number of grounding electric wires D to be conductively connected in a lump can be increased or decreased easily within the range of the number of terminal connection portions 21.

In addition, the engagement walls 22 that can be engaged with the fastening caulking pieces 132*a* are formed in the opposite side portions of the terminal connection portion 21. Accordingly, when the fastening caulking pieces 132*a* of the connection terminal 130 are caulked to the terminal connection portion 21, the fastening caulking pieces 132*a* are engaged with the engagement walls 22 of the terminal connection portion 21. Thus, the fastening caulking pieces 132*a* are surely crimped on the terminal connection portion 21 so that the connection strength of the connection terminal 130 to the terminal connection portion 21 can be further enhanced. It is therefore possible to stabilize electric resistance at the connection place to thereby improve the electric connection.

Further, in the connection method for the terminal fitting according to the second embodiment, at the same time as the terminal connection portion 21 of the terminal fitting 10 is caulked by the fastening caulking pieces 132*a* of the connection terminal 130, the convex strips 153 are formed in the opposed faces abutting against the terminal connection portion 21 in the terminal bottom portion 137 and the fastening caulking pieces 132*a* so that the concave grooves 155 can be formed in the terminal connection portion 21. Thus, the convex strips 153 and the concave grooves 155 are engaged with each other to thereby prevent the terminal connection portion 21 from coming out from the fastening connection portion 132. Thus, reliability in mechanical connection is improved in comparison with a structure in which connection is established only by caulking and fastening of the fastening caulking pieces 132*a*.

In addition, in the connection method for the terminal fitting according to the second embodiment, the concave grooves 155 extending in the width direction of the terminal connection portion 21 are engaged with the convex strips 153 extending in the width direction of the caulked fastening connection portion 132, so that the engagement margin of the concave-convex engagement portion can be increased. Thus, the terminal connection portion 21 is surely prevented from coming out from the fastening connection portion 132.

In addition, the convex strips 153 and the concave grooves 155 can be formed at the same time as the fastening caulking pieces 132*a* of the connection terminal 130 are crushed and caulked. Thus, increase in working cost can be suppressed.

In addition, the terminal connection portions 21 are extended radially within one and the same plane.

It is possible to provide a large number of terminal connection portions 21 while suppressing the area occupied by the terminal fitting 10 as much as possible. Thus, a large number of grounding electric wires D can be connected in a lump.

Incidentally, according to the second embodiment, concave-convex engagement is established by a configuration in which the convex strips 153 serving as convex engagement portions protruding inward are formed in the terminal bottom portion 137 and the fastening caulking pieces 132*a*, and the concave grooves 155 serving as concave engagement portions are formed in the outer surface of the terminal connection portion 21. The concave-convex engagement portion according to the invention is not limited thereto. That is, as the concave-convex engagement portion provided in the opposed faces where the terminal connection portion 21 and the fastening connection portion 132 abut against each other, various forms can be taken as long as the terminal connection portion 21 can be regulated from moving in the insertion direction of the terminal connection portion 21 to the fastening connection portion 312.

Incidentally, in the aforementioned first and second embodiments, grounding electric wires D of on-vehicle circuits (accessories) are connected to the terminal fitting 10 so that the grounding electric wires D can be grounded in a lump. However, electric wires to be connected to the terminal fitting 10 are not limited to the grounding ones.

In addition, the rotation stopper piece 15 is not provided in the terminal body 11 of the terminal fitting 10, but a step or a rotation stopper piece that can abut against the terminal fitting 10 to thereby serve as a rotation stopper when the terminal fitting 10 is attached to the grounding surface may be provided on the grounding surface side.

Incidentally, the invention is not limited to the aforementioned embodiments, but deformations, improvements, etc. can be made suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

Here, the features of the aforementioned embodiments of the connection structure and the connection method for the terminal fitting according to the invention will be summarized and listed briefly in the following paragraphs [1] to [4].

[1] A connection structure of a terminal fitting comprising:

the terminal fitting (10) including a terminal body (11), and a plurality of terminal connection portions (21) extending from the terminal body; and connection terminals (30) connected to end portions of electric wires (grounding electric wires D), wherein each of the connection terminals includes a pair of fastening caulking pieces (32*a*) which erects on opposite side portions of a terminal bottom portion (37), wherein the pair of the fastening caulking pieces are caulked with opposite side portions of a corresponding one of the terminal connection portions from outside so that the connection terminal is caulked and fastened to the terminal fitting, wherein concave-convex engagement portions are provided in opposed surfaces in which the terminal connection portion and the terminal bottom portion abut against each other, and wherein the terminal fitting is connected to the electric wires through the connection terminals.

[2] The connection structure of the terminal fitting according to [1], wherein each of the concave-convex engagement portions includes concave grooves (55) extending in a width direction of the terminal bottom portion and convex strips (53) extending in the width direction of the terminal connection portion.

[3] A connection method for a terminal fitting, in which the terminal fitting (10) includes a terminal body (11) and a plurality of terminal connection portions (21) extending from the terminal body, and a pair of fastening caulking pieces (132*a*) which erects on opposite side portions of a terminal bottom portion (137) in each of connection terminals (130) connected to end portions of electric wires (grounding electric wires D) is caulked and connected to a corresponding one of the terminal connection portions, the connection method comprising:

mounting the terminal connection portion on the terminal bottom portion; and crushing and caulking the fastening caulking pieces with outer sides of opposite side portions of the terminal connection portion, and forming convex engagement portions (convex strips 153) in an opposed face abutting against the terminal connection portion in at least one of the terminal bottom portion and the fastening caulking pieces so that the connection terminal and the terminal connection portion are concave-convex engaged.

[4] The connection method for the terminal fitting according to [3], wherein the fastening caulking pieces of the connection terminal are crushed and caulked so as to form the convex engagement portions including convex strips (153) which extend in a width direction.

DESCRIPTION OF REFERENCE NUMERALS AND SIGNS

10 terminal fitting, 11 terminal body, 21 terminal connection portion, 22 engagement wall (fastened caulking piece), 22*a* engagement piece, 30 connection terminal, 32 fastening connection portion, 32*a* fastening caulking piece, 36 rotation regulation face, 37 terminal bottom portion, D grounding electric wire (electric wire), S retention space

What is claimed is:

1. A connection structure of a terminal fitting comprising:

the terminal fitting including a terminal body, and a plurality of terminal connection portions extending from the terminal body, each terminal connection portion includes a first surface; and connection terminals connected to end portions of electric wires, wherein each of the connection terminals includes a pair of fastening caulking pieces which erects on opposite side portions of a terminal bottom portion, the terminal bottom portion includes a second surface, wherein the pair of the fastening caulking pieces are caulked with opposite side portions of a corresponding one of the terminal connection portions from outside so that the connection terminal is caulked and fastened to the terminal fitting, wherein the first surface of the connection portion opposes and abuts the second surface of the terminal bottom portion, wherein a convex engagement portion protrudes from one of the first surface and the second surface, and a concave engagement portion is recessed from a different one of the first and second surface and engages the convex engagement portion, wherein the terminal fitting is connected to the electric wires through the connection terminals.

2. The connection structure of the terminal fitting according to claim 1, wherein each of the concave-convex engagement portions includes concave grooves extending in a width direction of the terminal bottom portion and convex strips extending in the width direction of the terminal connection portion.

3. A connection method for a terminal fitting, in which the terminal fitting includes a terminal body and a plurality of terminal connection portions extending from the terminal body, and a pair of fastening caulking pieces which erects on opposite side portions of a terminal bottom portion in each of connection terminals connected to end portions of electric wires is caulked and connected to a corresponding one of the terminal connection portions, the connection method comprising:

mounting the terminal connection portion on the terminal bottom portion; and crushing and caulking the fastening caulking pieces with outer sides of opposite side portions of the terminal connection portion, and forming convex engagement portions in an opposed face abutting against the terminal connection portion in at least one of the terminal bottom portion and the fastening caulking pieces so that the convex engagement portions protrude from the opposed face and the connection terminal and the terminal connection portion are concave-convex engaged.

4. The connection method for the terminal fitting according to claim 3, wherein the fastening caulking pieces of the connection terminal are crushed and caulked so as to form the convex engagement portions including convex strips which extend in a width direction.

* * * * *